United States Patent [19]

Stanich

[11] Patent Number: 4,744,229

[45] **Date of Patent: * May 17, 1988**

[54] PADLOCK COVER

[75] Inventor: Judith A. Stanich, Pompano Beach, Fla.

[73] Assignee: Hot Locks, Inc., Pompano Beach, Fla.

[ * ] Notice: The portion of the term of this patent subsequent to Dec. 3, 2002 has been disclaimed.

[21] Appl. No.: 802,767

[22] Filed: Nov. 27, 1985

Related U.S. Application Data

[63] Continuation of Ser. No. 618,685, Jun. 8, 1984, Pat. No. 4,555,920, which is a continuation-in-part of Ser. No. 554,903, Nov. 25, 1983, Pat. No. 4,534,190.

[51] Int. Cl.[4] ..... E05B 67/38

[52] U.S. Cl. ..... 70/54; 70/56

[58] Field of Search ..... 70/54, 55, 56, 14, 51, 70/20, 417; 150/52

[56] References Cited

U.S. PATENT DOCUMENTS

| | | | |
|---|---|---|---|
| 3,533,253 | 10/1970 | Miller | 70/55 |
| 4,300,370 | 11/1981 | Kaiser | 70/54 |
| 4,555,920 | 12/1985 | Stanick | 70/54 |

FOREIGN PATENT DOCUMENTS

| | | | |
|---|---|---|---|
| 400959 | 8/1924 | Fed. Rep. of Germany | 70/55 |
| 203530 | 9/1923 | United Kingdom | 70/55 |
| 1365684 | 9/1974 | United Kingdom | 70/54 |

*Primary Examiner*—Robert L. Wolfe

*Attorney, Agent, or Firm*—Grimes & Battersby

[57] ABSTRACT

A padlock cover molded in one rigid piece and open at the back. The cover has a cylindrical inner wall for holding the body of a padlock, an outer side wall spaced laterally outward from the inner wall, and a front wall extending from the outer side wall laterally inward to the inner wall and slightly past it at the top. At the top on one side the inner wall and the outer side wall have vertically aligned openings for passing one leg of the usual inverted U-shaped shackle of the padlock. At the top on the opposite side the inner wall and the outer side wall have vertically aligned slots which are open at the back to pass the opposite leg of the padlock shackle.

11 Claims, 1 Drawing Sheet

FIG. 1
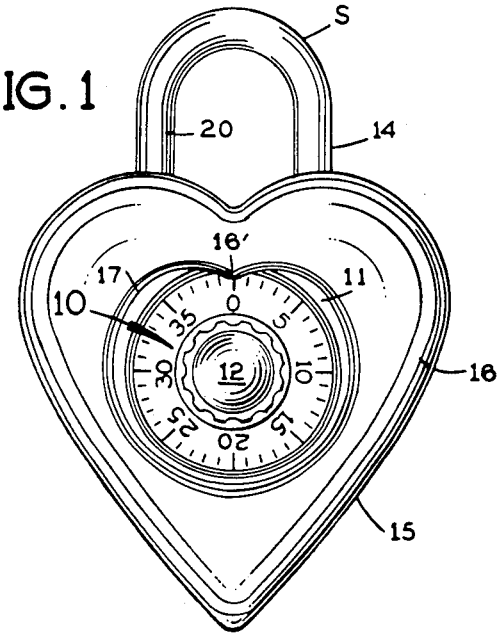
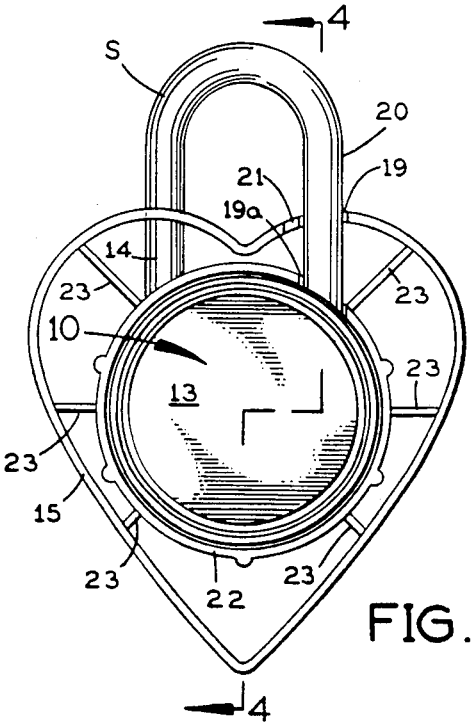
FIG. 2
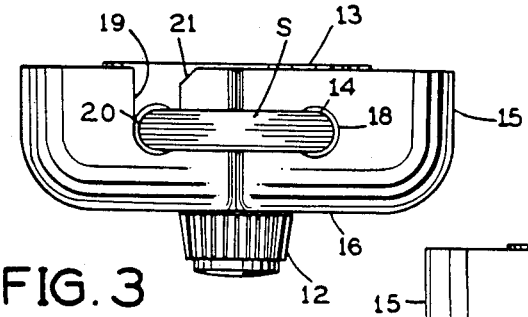
FIG. 3
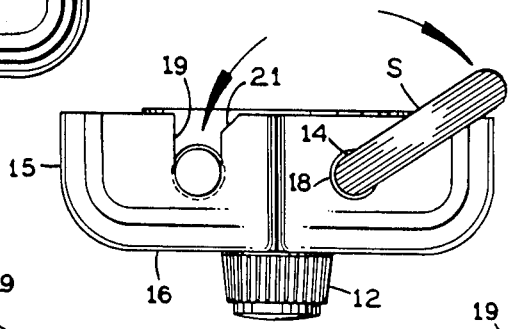
FIG. 5
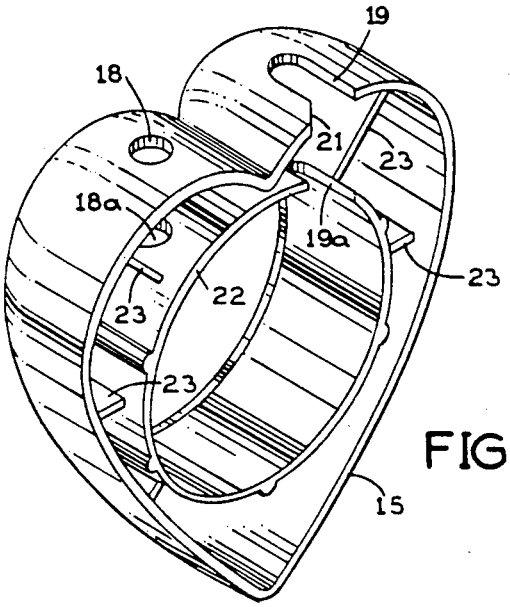
FIG. 6
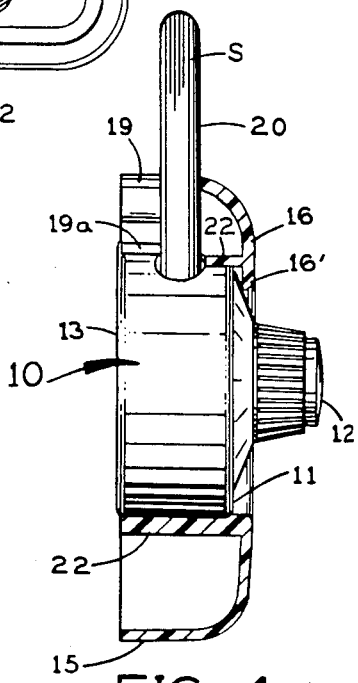
FIG. 4

PADLOCK COVER

This application is a continuation of application Ser. No. 618,685, filed June 8, 1984, now U.S. Pat. No. 4,555,920, which was a continuation-in-part of Ser. No. 554,903, filed Nov. 25, 1983, which issued on Aug. 13, 1985 as U.S. Pat. No. 4,534,190.

CROSS-REFERENCE TO RELATED APPLICATION

This invention is an improvement on the invention disclosed in my copending U.S. patent application Ser. No. 06/554,903, filed Nov. 25, 1983 and now U.S. Pat. No. 4,534,190.

SUMMARY OF THE INVENTION

This invention relates to a cover for a padlock.

One widely used type of padlock has a cylindrical body containing a combination lock operated by a rotatable knob on the front, and an inverted U-shaped shackle extending up from the body of the lock. Such locks are starkly utilitarian in appearance. The present invention is directed to a novel cover for attachment to such a lock to improve and individualize its appearance, making it readily identifiable from similar locks, such as in a row of lockers, as well as to protect the lock against damage from the outside.

The present cover is a one-piece, molded body, perferably of relatively rigid and hard plastic, which can be assembled on or removed from a padlock relatively easily when the lock is open but cannot be removed when the lock is closed except by damaging the cover itself. This inhibits a person from stealing the cover from another's padlock.

A principal object of this invention is to provide a novel cover for attachment to a padlock to improve its appearance and make it more readily distinguishable from other padlocks nearby.

Another object of this invention is to provide such a cover which is attachable to or removable from a padlock when it is open but is not removable when the lock is closed except by damaging the cover does not interfere with the usual operation of the padlock when the cover is in place.

Further objects and advantages of this invention will be apparent from the following detailed description of presently preferred embodiment which is illustrated schematically in the accompanying drawing.

DESCRIPTION OF THE DRAWING

FIG. 1 is a front elevational view of the cover of this invention in place on a padlock of conventional design;

FIG. 2 is a rear elevation of the padlock and cover assembly shown in FIG. 1;

FIG. 3 is a top plan view of the padlock and cover assembly with the shackle of the padlock in its closing position;

FIG. 4 is a vertical section taken along the line 4—4 in FIG. 2;

FIG. 5 is a top plan view of the padlock and cover assembly with the shackle of the padlock open and rotated from its closing position; and FIG. 6 is a rear perspective view of the present padlock cover.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Referring first to FIGS. 1 and 2, a padlock of known design is shown as having a cylindrical body 10 with a front end face 11 where a rotatable knob 12 is located and a back end face 13 (FIG. 2). The knob 12 operates a combination lock mechanism inside the body of the padlock in the usual manner. At the top the padlock has the usual rigid reciprocable and rotatable shackle S of inverted U-shape which is down (as shown) when the lock is closed and is displaceable upward with respect to the padlock body when the lock is open. When the lock is open, the padlock body may be rotated about one vertical leg 14 of the shackle, or vice versa, from the locking position of FIG. 3 to the released position of FIG. 5.

The present cover is a substantially rigid, one-piece molded body of suitable plastic material having a heat-shaped outer side wall 15, and a slightly rounded/convex, front wall 16 extending laterally inward from the outer side wall 15 to a central opening 17. At the top of opening 17 the front wall 16 of the cover presents a downwardly projecting central lip 16' which extends directly in front of the front end face 11 of the padlock body. Throughout its extent the edge of the opening 17 is a substantial distance radially outward from the knob 12 of the padlock so that it does not impede the user's fingers when he or she grasps the knob and turns it.

At the top on one side the outer side wall 15 of the cover presents a circular opening 18 (FIG. 6) which rotatably and slidably receives the leg 14 of the padlock shackle S, as shown in FIGS. 3 and 5. At the top on the opposite side the outer side wall 15 of the cover presents a slot 19 which is open at the back of the cover and has a rounded, closed front end. This slot slidably receives the opposite vertical leg 20 of the padlock shackle S. Slot 19 has a chamfered edge 21 on its inner side at the back of the cover to facilitate the movement of shackle leg 20 into or out of this slot when the shackle is rotated on its opposite leg 14.

The present cover has a cylindrical inner wall 22 spaced laterally inward from its outer wall 15 and joined to the outer wall by lateral ribs 23 extending between them, as shown in FIGS. 2 and 6. The cylindrical inside surface of inner wall 22 is substantially complementary to the cylindrical side wall of the padlock body 10, so that the padlock body is slidably but snugly received inside the inner side wall 22 of the cover, as shown in FIG. 2. At the lip 16' (FIG. 1) and on opposite sides of it along the top of the front opening 17, the front wall 16 of the cover extends laterally inward past the inner wall 22 to engage the front of the padlock body.

At the top on one side the inner side wall 22 has an opening **18*a* (FIG. 6) which is spaced below, and vertically aligned with, the opening 18 in the outer side wall 15. At the top on the opposite side the inner side wall 22 has a slot 19*a* (FIGS. 4 and 6) which is spaced below, and verticaly aligned with, the slot 19 in the outer side wall 15 and is the same size and shape as the latter, looking down on the cover from above it. The inner side wall opening 18a slidably and rotatably receives the padlock shackle leg 14, and the slot 19*a* slidably passes the opposite leg 20** of the shackle.

With the shackle S in an open position, the padlock 10 may be placed inside the present cover by positioning the padlock body behind the cover and sliding the free end of shackle leg 20 through opening 18*a* in the inner side wall 22 of the cover and then out through the aligned opening 18 in the outer side wall 15 of the cover, and then pushing the rest of the shackle through these openings until the opposite shackle leg 14 is in these openings and the padlock body is seated inside the inner side wall 22 of the cover, with the rotatable knob 12 of the padlock in front of the cover, as shown in FIG. 4. The shackle may be rotated from its released or unlocked position (FIG. 5) to the locking position (FIG. 3) in which its leg 10 may be pushed into the padlock body for locking engagement with the locking mechanism therein.

When the padlock is closed, the present cover cannot be removed from it because of the engagement of the shackle leg 14 in the openings 18 and 18*a* in the cover. This effectively prevents any removal of the cover by a person who does not know the combination to open the lock. When the lock is open, the present cover may be mounted on it or removed from it without great difficulty. Ordinarily, however, the owner will keep the cover on as long as the lock is in use since it provdes physical protection for the lock, as well as identifying it to the owner and improving its appearance.

I claim:

1. A cover for attachment to a padlock of the type having a body portion and an inverted, U-shaped shackle extending from said body portion, said cover having front and rear portions and including:

retaining means comprising a pre-formed inner wall portion which is generally complementary to the shape of the body portion of the padlock and is adapted to prevent movement of the body portion of said padlock within said cover in a first plane defined by the shackle, wherein said inner wall portion includes at least one aperture adapted to permit said shackle to pass therethrough; and securing means adapted to prevent movement of the body portion of said padlock within said cover in a second plane perpendicular to the first plane, wherein said cover further includes at least one aperture adapted to permit said shackle to pass therethrough.

2. The cover of claim 1, wherein said padlock has a generally cylindrical body portion.

3. The cover of claim 1, wherein said cover is formed from a deformable and resilient material.

4. The cover of claim 1, wherein said cover is substantially heart-shaped.

5. The cover of claim 1, wherein said inverted U-shaped shackle includes at least two opposed leg portions.

6. The cover of claim 1, wherein said padlock is a combination padlock.

7. The cover of claim 1, wherein said cover includes a pair of apertures.

8. The cover of claim 7, wherein at least one of side pair of apertures is a slot.

9. The cover of claim 1, wherein said securing means comprise at least one aperture on said cover which captures said shackle and thereby prevents movement of the body portion of said padlock within said cover in the plane perpendicular to the plane defined by said shackle.

10. A pre-formed cover for attachment to a padlock of the type having a body portion and an inverted, U-shaped shackle with opposite legs which extend from said body portion, said cover including:

retaining means within said cover adapted to prevent movement of the body portion of said padlock within said cover in a plane defined by the shackle, said retaining means comprising an inner wall portion complimentary in shape to the body of said padlock and adapted to restrict the movement of said padlock within said cover;

at least one aperture adapted to permit at least one of the legs of said shackle to pass therethrough; and securing means within said cover adapted to prevent movement of the body portion of said padlock with said cover in a plane perpendicular to the plane defined by the shackle.

11. A pre-formed cover of a resilient material for attachment to a padlock of the type having a body portion and an inverted, U-shaped shackle with opposite legs extending from said body portion, said cover including retaining means within said cover adapted to prevent movement of the body portion of said padlock within said cover in a plane defined by the shackle, said retaining means comprising an inner wall portion generally complimentary in shape to the body of said padlock and so positioned as to engage said body portion and thereby restrict the movement of the padlock with said cover;

at least one aperture adapted to permit at least one of the legs of said shackle to pass therethrough; and securing means within said cover adapted to prevent movement of the body portion of said padlock within said cover in a plane perpendicular to the plane defined by the shackle, wherein said securing means are positioned on the rear of the cover.

* * * * *